United States Patent [19]

Eny

[11] 4,349,299

[45] Sep. 14, 1982

[54] ROOF BOLT TENSION HEAD AND METHOD OF USE

[75] Inventor: Nicholas R. Eny, Cheverly, Md.

[73] Assignee: Stephen F. Koval, Portage, Pa.

[21] Appl. No.: 170,829

[22] Filed: Jul. 21, 1980

Related U.S. Application Data

[63] Continuation-in-part of Ser. No. 124,754, Feb. 26, 1980, abandoned.

[51] Int. Cl.[3] ..... E21D 20/02

[52] U.S. Cl. ..... 405/261; 411/1; 411/8; 411/15

[58] Field of Search ..... 405/260, 261; 411/1, 411/2, 8, 15, 82

[56] References Cited

U.S. PATENT DOCUMENTS

| | | | |
|---|---|---|---|
| 3,298,144 | 1/1967 | Fischer | 405/261 |
| 3,877,235 | 4/1975 | Hill | 405/261 |
| 3,896,627 | 7/1975 | Brown | 405/261 |
| 3,940,941 | 3/1976 | Libert et al. | 405/261 |
| 4,023,373 | 5/1977 | Hipkins | 405/261 |
| 4,051,683 | 10/1977 | Koval | 405/261 |
| 4,122,681 | 10/1978 | Vass et al. | 405/261 |
| 4,127,000 | 11/1978 | Montgomery, Jr. et al. | 405/261 |
| 4,129,006 | 12/1978 | Rausch | 405/261 |
| 4,193,715 | 3/1980 | Vass | 411/8 X |

*Primary Examiner*—Ernest R. Purser

*Attorney, Agent, or Firm*—Buell, Blenko, Ziesenheim & Beck

[57] ABSTRACT

The tension head comprises essentially a sleeve with a threaded bore having opposed keyways extending therethrough. In those keyways is supported a U-shaped stop member. When the sleeve is turned up on the end of the bolt protruding from the hole until that end abuts the cross piece of the stop member, rotation of the sleeve rotates the bolt. When the inner end of the bolt is bonded to the rock, further rotation of the sleeve causes the stop member to break or deform. The lower end of the bolt pushes the deformed stop member or its fragments out through the bottom of the sleeve along the keyways.

11 Claims, 11 Drawing Figures

Fig. I.
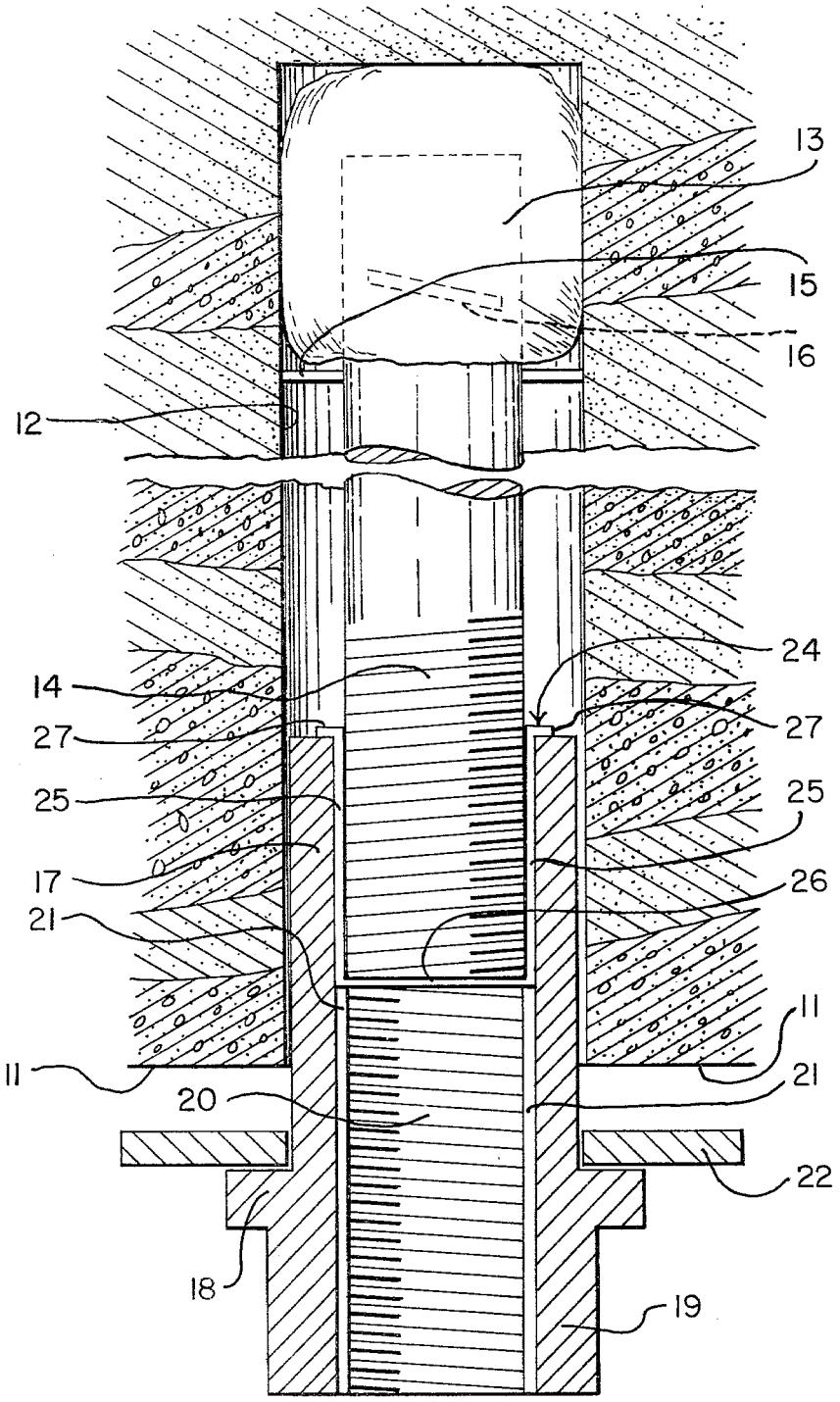

ROOF BOLT TENSION HEAD AND METHOD OF USE

This application is a continuation-in-part of my application Ser. No. 124,754, filed Feb. 26, 1980, now abandoned.

This invention relates to a tension head or member for bolts used to secure rock structures such as stratified rock structures in the roofs of underground mines. It is more particularly concerned with such a head which rotates the bolt while it is being inserted into a drill hole and also tensions the bolt when its inner end is fixed to the hole.

BACKGROUND OF INVENTION

It is common practice in coal mines and other mines to fix the ends of roof bolts in holes bored in the mine roof with a thermosetting resin compound. The compound is furnished to the mine encased in a plastic bag or like package that can be inserted into the drilled hole, and usually comprises a resin, such as a polyester, and a curing agent separated from the resin. The package is inserted into the hole; the roof bolt is pushed up against it and rotated to rupture the container and mix the resin and curing agent. The mixing is necessary to achieve a uniform composition of the resin compound. The roof bolt is then held stationary in place while the compound sets or cures. Quick curing resins are generally used which solidify in a few minutes. When the upper end of the roof bolt is bonded to the roof, a perforated plate and nut are applied to its lower end and the nut is tightened to tension the bolt and exert pressure on the roof.

A number of devices have been devised to rotate the roof bolt to mix the resin and then apply tension to the bolt after its end is bonded to the roof. A conventional device is a shear pin of some sort. A drawback of prior art shear pin devices is that the pin after shearing remains in the bolt and the nut or other tightening member, and may jam them so as to prevent tightening of the nut on the bolt. When this occurs in the hole, there is no way to free the nut.

SUMMARY OF THE INVENTION

It is a principal object of my invention to provide a roof bolt tension head with a shear pin member which avoids the difficulties above mentioned by causing the shear pin to fall or to be pushed out of contact with threads of the bolt and tension head after it has served its purpose. It is another object to provide a method of inserting a roof bolt in a drill hole, bonding it in place, and applying tension to it. My tension head comprises essentially a sleeve with a threaded bore having opposed keyways extending therethrough. In those keyways is fitted a U-shaped stop member, which may be hat-shaped. The stop member is supported in the keyways, as will be described. When the sleeve is turned up on the end of the bolt protruding from the hole until that end abuts the cross piece of the stop member, rotation of the sleeve rotates the bolt. When the inner end of the bolt is bonded to the rock, further rotation of the sleeve causes the stop member to break or deform so that its legs are completely received in their respective keyways. The lower end of the bolt pushes the deformed stop member out through the bottom of the sleeve.

BRIEF DESCRIPTION OF DRAWINGS

FIG. 1 is a vertical cross section of a roof bolt and tension head of my invention inserted into a hole in a mine roof.

DESCRIPTION OF A FIRST PREFERRED EMBODIMENT

Figures 1A, 2, 3, 4, 5, 6, 7, 8:
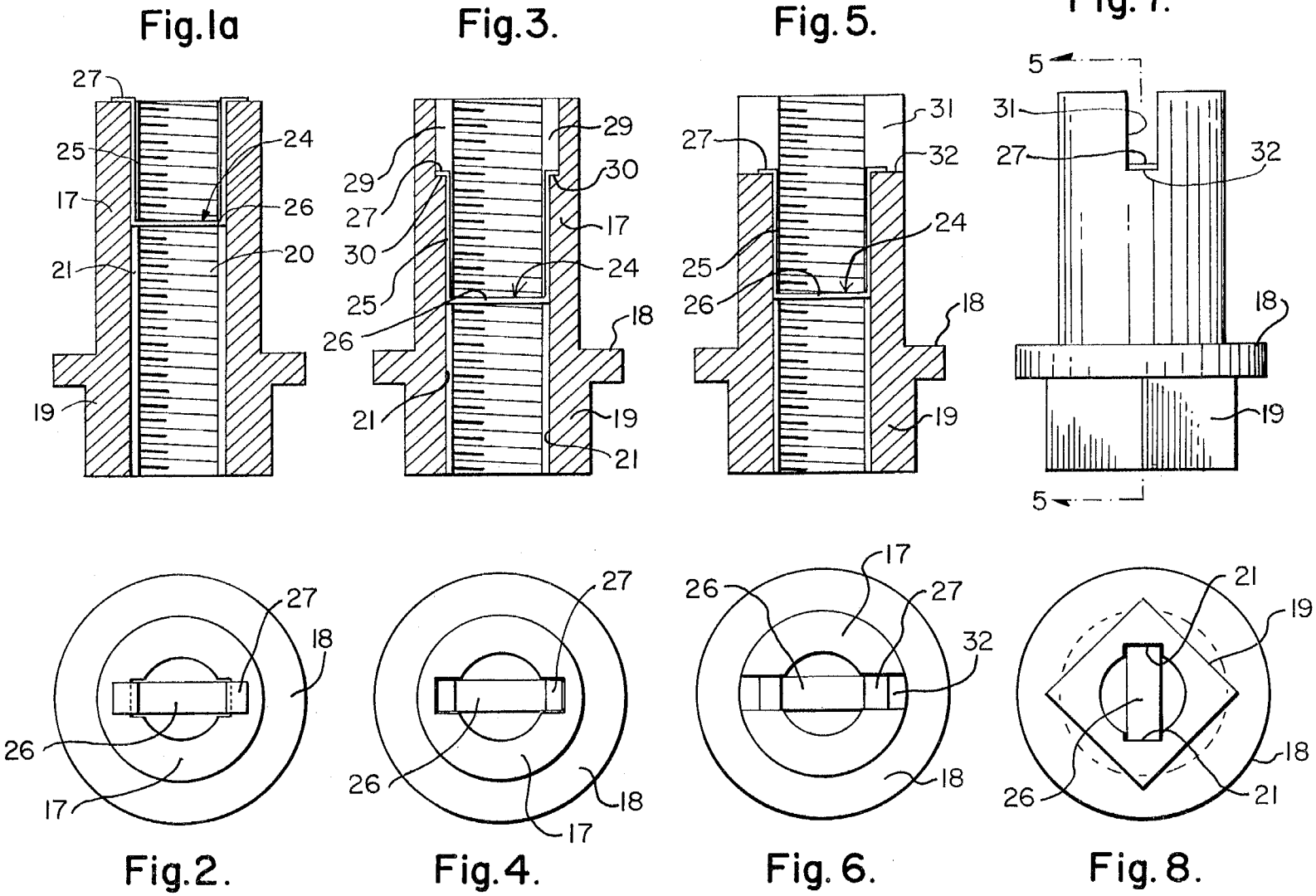
FIG. 1*a* is a vertical cross section through the tension head of FIG. 1.
FIG. 2 is a plan of the tension head of FIG. 1.
FIG. 3 is a vertical cross section through a modification of the tension head of FIG. 1.
FIG. 4 is a plan of the modification of FIG. 3.
FIG. 5 is a vertical cross section through a second modification of the tension head of FIG. 1 taken on the plane 5—5 of FIG. 7.
FIG. 6 is a plan of the modification of FIG. 5.
FIG. 7 is an elevation of the tension head of FIG. 5.
FIG. 8 is a bottom view of the tension head of FIG. 7.

In FIG. 1 a hole 12 is shown drilled in the roof 11 of an underground mine. Into hole 12 is inserted a package 13 containing a thermosetting resin and a curing agent therefore in separate compartments. A threaded roof bolt 14 is then pushed up into hole 12, the end of the roof bolt being fitted with a washer 15, which seals off hole 12. As roof bolt 14 is advanced, it pushes package 13 up against the inner end of hole 12 and ruptures it, allowing the resin and curing agent to come into contact with each other. Washer 15 confines the contents of package 13 to the upper end of the hole 12 adjoining the upper end of roof bolt 14. That end is formed with projecting ribs 16 to facilitate mixing of the resin compound.

In order to rotate roof bolt 14 the tension head of my invention is screwed onto its lower end. That head, shown in section in FIG. 1*a* and in plan in FIG. 2, comprises a sleeve 17 having a threaded bore 20 which meshes with the threaded end of roof bolt 14. Sleeve 17 is formed with diametrically opposed keyways 21 extending through bore 20. Those keyways are also shown in plan in FIG. 8. The outside or lower end of sleeve 17 is formed with wrench flats 19, also shown in plan in FIG. 8. Between wrench flats 19 and the remaining length of sleeve 17 is interposed an outwardly extending flange 18, which supports a perforated plate 22.

Positive rotation of bolt 14 by sleeve 17 is obtained by stop member 24, shown in all figures, which is fitted into keyways 21. Member 24 is hat-shaped in elevation and comprises parallel longitudinal members 25 joined at one end by cross piece 26. Their other ends are outwardly turned lugs 27. The stop member is inserted into keyways 21 with its cross piece 26 nearer wrench flats 19 and its lugs 27 resting on the other end of sleeve 17 at the ends of keyways 21. Longitudinal members 25 lie entirely within keyways 21. When sleeve 17 is turned up on bolt 14 until cross piece 26 abuts the lower end of bolt 14 further rotation of sleeve 17 causes bolt 14 to rotate likewise, so bringing about the mixing of the contents of package 13.

As is shown in FIG. 1, sleeve 17 is dimensioned so that its end carrying stop member 24 enters hole 12. It is not necessary that roof bolt 14 extend outside of hole 12 below the plane of roof 11. In order to apply tension to roof bolt 14 after its inner end is bonded to the rock by the resin in hole 12, sleeve 17 is further rotated. The advancement of sleeve 17 on bolt 14 causes lugs 27 to be broken off or bent upwardly until they are more or less parallel with members 25 and lie entirely within keyways 21 of sleeve 17. Stop member 24 is at the same time pushed toward wrench flats 19 by the lower end of roof bolt 14, and cannot cause sleeve 17 to jam on bolt 14. If sleeve 17 is advanced on bolt 14 sufficiently stop member 24 is pushed or falls out through the wrench flats end of sleeve 17. As sleeve 17 is advanced on bolt 14 plate 22 is pressed against mine roof 11.

A modification of my tension head 24 is illustrated in FIGS. 3 and 4. Keyways 21 extend from the end of sleeve 17 carrying wrench flats 19 to a point intermediate flange 18 and the other end of sleeve 17. There their depths are increased, and the keyways 29 of increased depths so formed extend to the other end of sleeve 17. A ledge 30 joins each keyways 21 with its corresponding keyway 29, and stop member 24 is inserted onto keyways 29 so that its outturned lugs 27 rest on ledges 30.

A further modification is illustrated in FIGS. 5 through 8. The depth of keyways 29 is increased to the full thickness of the wall of sleeve 17 so as to form a slot 31 extending through the walls of sleeve 17 on a diameter of that sleeve. The slot has a flat bottom 32 on each side of sleeve 17 on which rest the outturned lugs 27 of stop member 24.

DESCRIPTION OF A SECOND PREFERRED EMBODIMENT

Figure 9:
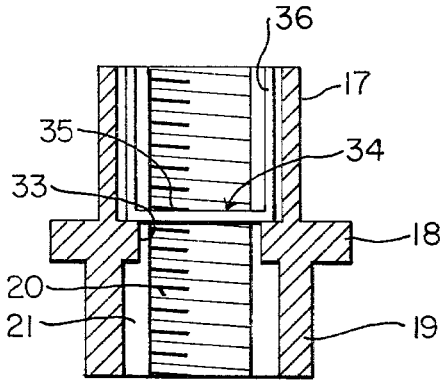
FIG. 9 is a vertical cross section through the tension head of a further embodiment of my invention.
Figure 10:
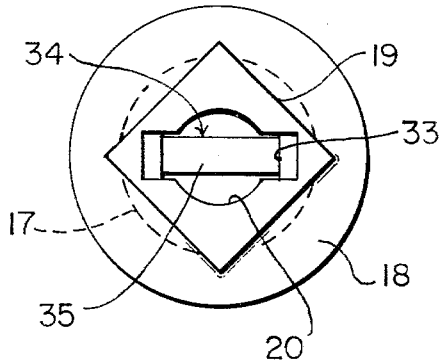
FIG. 10 is a bottom view of the tension head of FIG. 9.

FIGS. 9 and 10 illustrate still another embodiment of my invention. As in the embodiment of FIG. 1 keyways 21 in bore 20 extend the length of sleeve 17. Intermediate the ends of each keyway is a projection or shoulder 33 which extends inwardly of the sleeve a distance less than the depth of keyway 21. The axial length of shoulder 33 is only a small fraction of the length of sleeve 17. On shoulders 33 is supported stop member 34 which is U-shaped element made of strip of a width less than keyways 21. The base 35 of stop member 34 rests on shoulders 33 and its legs 36 extend upwardly in keyways 21. When the tension head is screwed up against the bolt end the latter forces base 35 down between shoulders 33 in the clearance space between those shoulders and the bore 20 of the sleeve, deforming or breaking base 35 adjoining its function with legs 36. In either case the clearance between shoulders 33 and the bolt end in bore 20 is sufficient to allow the deformed stop member 34, intact or in fragments, to be pushed out through keyways 21, as has been previously described.

I claim:

1. A tension head for a bolt inserted in a drill hole in a rock formation comprising a sleeve with a threaded bore extending therethrough, wrench flats at one end of the sleeve, a pair of oppositely disposed keyways extending through the bore, and stop means fitted in the keyways and supported by the sleeve for forced engagement with the bolt end when the sleeve is screwed thereon, whereby rotation of the sleeve rotates the bolt, but which are deformed by further rotational advance of the sleeve on the bolt so as to be pushed toward the wrench flat end of the sleeve by the bolt end.

2. The tension head of claim 1 having an outwardly extending flange intermediate the wrench flats and the other end of the sleeve.

3. The tension head of claim 1 in which the stop means are supported from the other end of the sleeve.

4. The tension head of claim 1 in which the stop means comprises a strip of material of width less than that of the keyways formed in hat shape and supported from the other end of the sleeve by its outturned ends.

5. The tension head of claim 4 in which the cross piece of the hat-shaped stop means is positioned intermediate the ends of the sleeve.

6. The tension head of claim 1 in which the depth of the keyways intermediate the ends of the sleeve and extending to the other end of the sleeve is increased to form shoulders therein supporting the stop means.

7. The tension head of claim 6 in which the increased keyway depth extends through the wall of the sleeve.

8. The tension head of claim 1 in which the keyways intermediate the ends of the sleeve have shoulders of an axial length less than the axial length of the sleeve, which shoulders support the stop means.

9. The tension head of claim 8 in which the radial width of the shoulders is less than the depth of the keyways.

10. The tension head of claim 8 in which the stop means comprises a U-shaped strip of material of width less than that of the keyways the legs of the U lying in the keyways and the base of the U being supported by the shoulders.

11. The method of supporting a rock formation through holes drilled therein comprising inserting in the hole a packaged resin system, advancing bolt into the hole to fracture the packaged resin system, screwing onto the outer end of the bolt a threaded sleeve supporting a bearing plate, the sleeve having oppositely disposed keyways extending therethrough and stop means fitted in the keyways and supported by the sleeve, so as to force the stop means against the bolt end, then rotating the sleeve and bolt as a unit so as to mix the resin, then supporting the bolt without rotating it until the resin cures and bonds the inner end of the bolt to the rock formation, and then further screwing the sleeve on the bolt to deform the stop means and push them toward the outer end of the sleeve, whereby the sleeve forces the bearing plate against the rock face and tensions the bolt.

* * * * *